United States Patent [19]

McCoy

[11] 4,449,589

[45] May 22, 1984

[54] FIRE CONTAINMENT DEVICE AND METHOD

[76] Inventor: John T. McCoy, 613 N. 5th St., Kansas City, Kans. 66101

[21] Appl. No.: 312,142

[22] Filed: Oct. 16, 1981

[51] Int. Cl.[3] ..... A62C 7/00

[52] U.S. Cl. ..... 169/48; 49/379; 98/86

[58] Field of Search ..... 169/48, 45, 43, 54, 169/56, 57; 49/1, 7, 8, 404, 379; 160/1; 137/68 R, 68 A, 87, 72; 267/166; 98/85, 86; 29/446; 83/DIG. 1

[56] References Cited

U.S. PATENT DOCUMENTS

| | | | |
|---|---|---|---|
| 1,243,101 | 10/1917 | Puhl | 49/379 |
| 2,863,357 | 12/1958 | Peterson | 29/446 |
| 3,047,983 | 8/1962 | Wasserman | 98/86 |
| 3,189,142 | 6/1965 | Carlson | 49/379 |
| 3,670,873 | 6/1972 | Dwyer, Jr. | 29/446 |
| 4,000,888 | 1/1977 | Gardner et al. | 83/DIG. 1 |
| 4,108,195 | 8/1978 | Berry | 169/48 |

FOREIGN PATENT DOCUMENTS

| | | | |
|---|---|---|---|
| 2854267 | 6/1980 | Fed. Rep. of Germany | 49/1 |
| 34705 | 9/1981 | Fed. Rep. of Germany | 169/48 |

*Primary Examiner*—Joseph J. Rolla
*Assistant Examiner*—Kenneth Noland
*Attorney, Agent, or Firm*—Kokjer, Kircher, Bradley, Wharton, Bowman & Johnson

[57] ABSTRACT

A fire activated device which closes off a wall opening through which a plastic pipe or other fusible member extends. The device includes a back plate which is mounted to the wall with an opening in the plate in alignment with the wall opening which receives the pipe. A spring loaded cutting blade is normally held away from the pipe by a fuse plug which melts in the event of a fire. The blade is then released and cuts through the pipe under the influence of the springs. A stop plate holds the blade in position to cover the opening to prevent fire from passing through it to the adjoining room. The springs are shielded from the heat by telescoping tubes which contain them.

5 Claims, 2 Drawing Figures

FIRE CONTAINMENT DEVICE AND METHOD

BACKGROUND AND SUMMARY OF THE INVENTION

This invention relates generally to the containment of fires and more paticularly to a device which is activated automatically in the event of a fire to prevent the fire from passing through openings in the walls, floors or ceilings of a building.

The common use of plastic pipe and other easily melted objects contributes significantly to the spread of fire through walls, floors and ceilings. The wall or floor openings which receive the plastic pipes and other objects are left in a completely exposed condition when the plastic materials melt under the extreme heat to which they are subjected during a fire. The fire is then able to pass freely through the exposed openings, and it quickly reaches adjoining rooms and spreads throughout the building. In addition to plastic pipe, other objects which often extend through walls, floors, and/or ceilings include electrical wiring; electrical conduit and ventilating ducts. If any of these objects should melt during a fire, their openings are exposed and provide a path by which the fire can rapidly spread throughout a building.

It is the primary object of the present invention to provide a fire containment device and method which inhibits the spreading of fire by acting automatically in the event of a fire to close off a building opening through which a plastic pipe or other fusible member extends.

Another object of the invention is to provide a fire containment device of the character described in which a cutting blade acts to shear the pipe and cover the exposed opening.

Yet another object of the invention is to provide, in a device of the character described, means for accurately guiding the blade and positioning it to tightly cover the wall opening.

A further object of the invention is to provide a device of the character described which is constructed in a manner to withstand extreme heat and to function reliably under fire conditions.

An additional object of the invention is to provide a device of the character described which is well adapted for use in connection with plastic pipes, electrical cables and wires, conduits of various types, air ducts, and virtually any other fusible object that passes through a wall, floor or ceiling.

A still further object of the invention is to provide a device of the character described which is simple and economical to construct and install and which can be safely handled. In the latter respect, the device is provided with removable safety bolts which assure that the blade will not be inadvertently released during shipping, handling or installation.

Other and further objects of the invention, together with the features of novelty appurtenant thereto, will appear in the course of the following description.

DETAILED DESCRIPTION OF THE INVENTION

Figure 1:
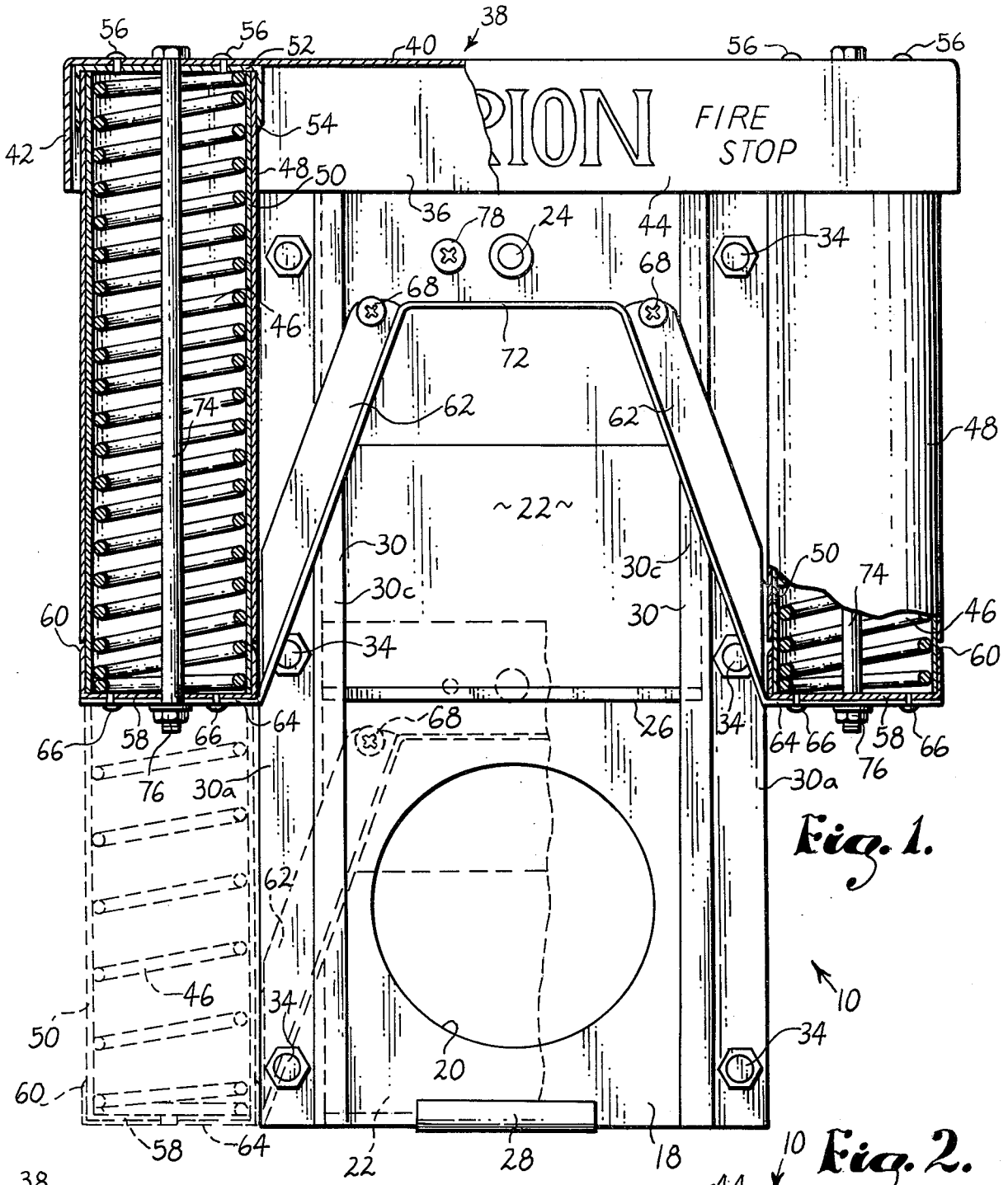
Figure 2:
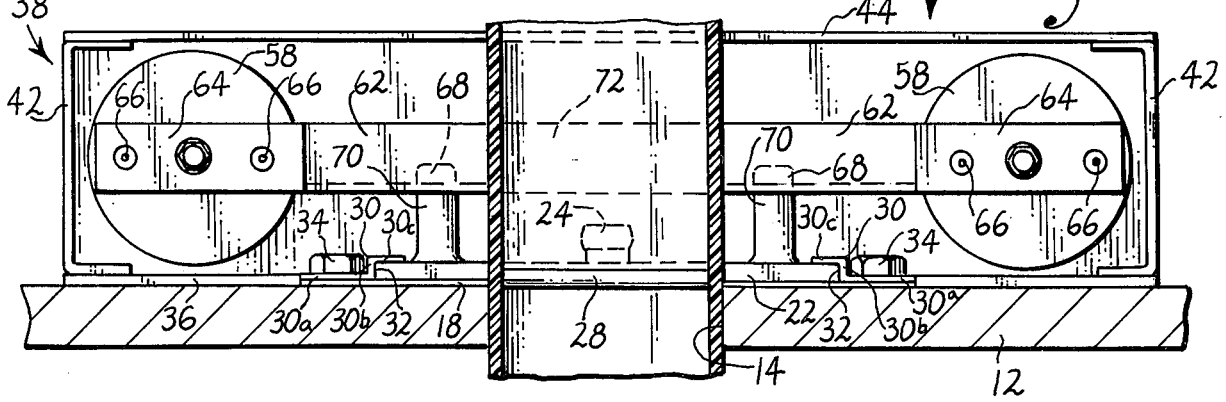

In the accompanying drawing which forms a part of the specification and is to be read in conjunction therewith and in which like reference numerals are used to indicate like parts in the various views:

FIG. 1 is a front elevational view of a fire containment device constructed according to a preferred embodiment of the present invention, with portions broken away for purposes of illustration and the broken lines indicating the activated position of the cutting blade; and FIG. 2 is a bottom plan view showing the device mounted to a wall through which a plastic pipe extends.

Referring now to the drawing in more detail, numeral 10 generally designates a fire containment device constructed in accordance with the present invention. The device 10 serves to prevent fire from passing through a wall 12 having an opening 14 through which a plastic pipe 16 extends. The device is equally useful in closing off other building openings such as those formed in floors and ceilings, and the opening which are closed by the device can receive a wide variety of objects such as electrical cables or wiring, ventilating ducts, or conduits of various types.

The fire containment device 10 includes a flat metal back plate 18 having a round opening 20 that aligns with the wall opening 14 when the back plate is mounted to wall 12. The plastic pipe 16 normally extends through the aligned openings 14 and 20. A cutting blade 22 is mounted against the surface of plate 18 opposite the side which contacts wall 12. A fuse plug 24 connects the back plate 18 and cutting blade 22 to normally hold the blade well above opening 20. The fuse plug 24 melts when exposed to extreme heat indicative of a fire, and blade 22 is then released from the back plate. The cutting blade terminates at its lower end in a sharp cutting edge 26 which is capable of cutting through the plastic conduit 16.

When the cutting blade 22 is released due to melting of the fuse plug 24, the blade moves downwardly from the solid line position of FIG. 1 to the position shown in broken lines. A curved stop plate 28 projects from the lower end of back plate 18 and is located below blade 22. The stop plate 28 provides a channel that receives the lower cutting edge 26 of blade 22 in order to hold the blade in the position shown in broken lines in FIG. 1, in which position the blade completely covers openings 14 and 20. The stop plate 28 thus prevents blade 22 from moving downwardly far enough to bypass opening 20.

Movement of cutting blade 22 is guided by a pair of rails 30 located adjacent the opposite side edges of the blade. Each rail 30 has a flat flange **30*a* which is secured to the surface of back plate 18 by welding or in any other suitable manner. Central portions 30*b* of rails 30 extend away from plate 18 and connect with flanges 30*c* which are offset from back plate 18 to provide open channels 32 which closely receive the opposite side edge portions of blade 22. The flanges 30*c* hold blade 22 against back plate 18 at all times, and the close fit of the blade edges in channels 32 restricts the cutting blade to vertical movement and prevents twisting or skewing of the blade. Bolts 34 extend through flanges 30*a* and back plate 18 to secure the device in the proper position on wall 12** or any other surface to which the device is mounted.

The upper portion of back plate 18 extends along and is welded or otherwise secured to the back panel 36 of a cap 38 located on top of the device. The cap 38 includes a top 40 which is welded to the back panel 36 and which terminates in opposite ends 42 that are likewise welded to panel 36. A front panel 44 of the cap is welded to top 40 and ends 42. As best shown in FIG. 1, the front panel 44 can be provided with promotional or informational material if desired.

The cutting blade 22 is forcefully urged downwardly toward the plastic pipe 16 by a pair of relatively strong compression springs 46. The springs 46 are coiled within telescoping tube assemblies located on opposite sides of the device. Both of the tube assemblies are constructed identically, and only one will be described in detail. Each tube assembly includes a stationary outside tube 48 and a movable inside tube 50 which is received within the outside tube 48 and is extensible and retractable with respect thereto in telescoping fashion. Each of the outside tubes 48 is covered at the top by a cover 52 and is welded at 54 to the lower edge of a flange forming part of the cover. Rivets 56 secure covers 52 to the top 40 at locations adjacent the opposite ends 42 of cap 38.

Each of the inside tubes 50 is received in a telescopic manner within the corresponding outside tube 48. The bottom end of each tube 50 is closed by a cover 58 having a flange which is welded at 60 to the inside tube 50. The compression springs 46 are contained within the inside tubes 50 and act upwardly against cover 52 and downwardly against the bottom cover 58, thereby continuously urging the inside tubes 50 downwardly toward the extended positions thereof in a forceful manner. The tubes 48 and 50 and associated components are preferably constructed of stainless steel in order to effectively shield the springs 46.

The cutting blade 22 is connected with the inside tubes 50 by respective arms 62 formed by angle members. The lower end of each arm 62 connects with a metal bar 64 which extends along the underside of the bottom cover 58 and is secured thereto by rivets 66. A screw 68 extends through the top end portion of each arm 62 and is threaded into a boss 70 (see FIG. 2) which projects from cutting blade 22 and is welded or otherwise secured thereto. The bosses 70 are located near the opposite side edges of blade 22. It should be apparent that the downward force exerted on the inside tubes 50 by springs 46 is transmitted to blade 22 by arms 62 and the associated components such that the springs forcefully urge blade 22 downwardly toward pipe 16. The arms 62 angle upwardly and inwardly from the lower ends of the tube assemblies and are interconnected at their top ends by a horizontal bar 72.

During shipping, handling and installation of the device, blade 22 is securely held in its normal position (broken lines in FIG. 1) by a pair of elongate safety bolts 74 which extend through the telescoping tube assemblies. The head of each bolt 74 contacts the top 40 of cap 38, and a nut 76 is threaded onto the lower end of each bolt and against the bottom of the corresponding bar 64. Bolts 74 prevent tubes 50 from extending downwardly and thus hold blade 22 firmly in place to prevent it from inadvertently releasing. As an additional safety precaution, a screw 78 is threaded through blade 22 and back plate 18 to prevent the blade from releasing during shipping, handling or installation.

In use, the device is mounted to wall 12 by means of the bolts 34 or in any other suitable manner. The opening 20 in back plate 18 aligns with the wall opening 14 so that the plastic pipe 16 can extend through the aligned openings. After the device has been installed, screw 78 is removed and nuts 76 are loosened to permit removal of the safety bolts 74. This leaves only the fusible plug 24 holding blade 22 against the force of springs 46.

In the event of a fire, plug 24 melts and thus releases blade 22 which moves downwardly in a forceful manner under the influence of the springs 46. The sharp cutting edge 26 of the blade is thus forced through the plastic pipe 16, and the blade moves downwardly until it engages the stop plate 28 which holds it in the broken line position shown in FIG. 1. In this position, pipe 16 is completely sheared and blade 22 completely covers openings 14 and 20 to close them off and prevent smoke and fire from spreading through the wall opening to the adjoining room. Flanges **30*c* of rails 30 hold blade 22 tightly against back plate 18 to assure that the blade fully closes the opening. During movement of the blade from the normal position to the activated position shown in broken lines in FIG. 1, the channels 32** guide the blade and prevent it from twisting or moving other than straight downwardly.

The inside tubes 50 slide within the outside tubes 48 and, when blade 22 has engaged stop 28, each inside tube 50 has reached the fully extended position shown in broken lines in FIG. 1. In this position, the upper end of each inside tube 50 remains within the outside tube such that springs 46 are completely enclosed within the tube assemblies at all times. The tube assemblies thus provide effective heat deflectors or shields which protect the enclosed springs 46 from the extreme temperatures which could otherwise adversely affect the springs and cause them to prematurely set or lose power.

It will be understood that the two spring arrangement may be altered by using a centered single spring, or other biasing arrangements which will effectively drive the blade through its operations upon release of the blade holding means.

As previously indicated, the fire containment device is useful in connection with fusible members other than the plastic pipe 16, and it can be mounted to a floor, ceiling or other surface through which the fusible member passes. If members such as a series of electrical cables or wires are to be accommodated, the back plate 18 is replaced by an alternative back plate having a series of openings sized and located to align with the wall openings that receive the cables or wires. The device 10 is preferably constructed entirely of steel or another fire resistant material which is able to withstand the high temperatures associated with fire conditions.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or in the accompanying drawing is to be interpreted as illustrative and not in a limiting sense.

Having thus described the invention, I claim:

1. Fire containment apparatus operable under fire conditions to close a building opening which extends through a building surface and which receives a fusible member such as a conduit or the like, said apparatus comprising:

a plate member adapted to be mounted to the building surface and having an opening for alignment with the building opening to permit the conduit to extend through the aligned openings with the aligned openings providing the sole passage through the building surface;

a blade having a cutting edge adapted to cut through the condut;

means for mounting said blade on the plate member in a manner to slide thereon between a normal position wherein the blade is offset from said opening in the plate member and an activated position wherein said blade covers the opening in the plate member, said blade being held closely against said plate member in the activated position to completely close the aligned opeings;

means for forcefully biasing said blade toward the activated position thereof, said biasing means including a spring acting in a manner to forcefully urge said blade toward the activated position and a fire resistant tube substantially enclosing said spring therein to provide a heat shield for the spring;

temperature sensitive means for holding said blade in the normal position at temperatures below a predetermined level indicative of fire conditions, said temperature sensitive means releasing the blade when said preselected temperature level is reached, whereby under fire conditions the blade moves to the activated condition and cuts through the conduit under the influence of said biasing means to completely close the aligned openings to prevent fire from spreading through the building opening.

2. Fire containment apparatus operable under fire conditions to close a building opening which extends through a building surface and which receives a fusible member such as a conduit or the like, said apparatus comprising:

a plate member adapted to be mounted to the building surface and having an opening for alignment with the building opening to permit the conduit to extend through the aligned openings with the aligned openings providing the sole passage through the building surface;

a blade having a cutting edge adapted to cut through the conduit;

means for mounting said blade on the plate member in a manner to slide thereon between a normal position wherein the blade is offset from said opening in the plate member and an activated position wherein said blade covers the opening in the plate member, said blade being held closely against said plate member in the activated position to completely close the aligned openings;

means for forcefully biasing said blade toward the activated position thereof, said biasing means including a compression spring, a first fire resistant tube connected with said plate member, and a second fire resistant tube connected with said blade and coupled with the first tube for telescopic extension and retraction relative thereto, said compression spring being enclosed within said first and second tubes to be shielded from heat thereby and urging said second tube to extend relative to said first tube to urge said blade toward the activated position;

temperature sensitive means for holding said blade in the normal position at temperatures below a predetermined level indicative of fire conditions, said temperature sensitive means releasing the blade when said preselected temperature level is reached, whereby under fire conditions the blade moves to the activated condition and cuts through the conduit under the influence of said biasing means to completely close the aligned openings to prevent fire from spreading through the building opening.

3. Apparatus as set forth in claim 2, including a removable safety element interconnecting said first and second tubes to prevent extension of the second tube to thereby hold said blade in the normal position thereof for safety purposes during handling and installation.

4. Fire containment apparatus operable under fire conditions to close a building opening which extends through a building surface and which receives a fusible member such as a conduit or the like, said apparatus comprising:

a plate member adapted to be mounted to the building surface and having an opening for alignment with the building opening to permit the conduit to extend through the aligned openings with the aligned openings providing the sole passage through the building surface;

a blade having a cutting edge adapted to cut through the conduit;

means for mounting said blade on the plate member in a manner to slide thereon between a normal position wherein the blade is offset from said opening in the plate member and an activated position wherein said blade covers the opening in the plate member, said blade being held closely against said plate member in the activated position to completely close the aligned openings;

means for forcefully biasing said blade toward the activated position thereof, said biasing means including a pair of telescoping tube assemblies each including first and second interfitting tubes constructed of fire resistant material, each of said first tubes being connected with said plate member and each of said second tubes having a retracted position inside of the corresponding first tube and an extended position extending out of the corresponding first tube, a compression spring in each tube assembly urging each second tube toward the extended position, each spring being substantially enclosed by the first and second tubes in both the extended and retracted positions to be shielded thereby from heat, and means for connecting the respective second tubes with said blade in a manner to effect movement of the blade to its activated position upon extension of said second tubes to the extended position;

temperature sensitive means for holding said blade in the normal position at temperatures below a predetermined level indicative of fire conditions, said temperature sensitive means releasing the blade when said preselected temperature level is reached, whereby under fire conditions the blade moves to the activated condition and cuts through the conduit under the influence of said biasing means to completely close the aligned openings to prevent fire from spreading through the building opening.

5. Apparatus as set forth in claim 4, including a removable safety element interconnecting at least one pair of first and second tubes to hold the blade in the normal position thereof for safety purposes during handling and installation.

* * * * *